US005943886A

United States Patent [19]

Chiang

[11] Patent Number: 5,943,886

[45] Date of Patent: Aug. 31, 1999

[54] CHEST LOCK HAVING A LINKING ACTION

[75] Inventor: Chih-Chang Chiang, Taichung Hsien, Taiwan

[73] Assignee: Chih-Tien Chiang, Taichung, Taiwan

[21] Appl. No.: 09/205,260

[22] Filed: Dec. 4, 1998

[51] Int. Cl.[6] ..... E05B 65/52

[52] U.S. Cl. ..... 70/70; 70/71; 70/72; 70/73; 70/432; 292/36; 292/150

[58] Field of Search ..... 70/69–75, 79, 70/80, 432; 292/36, 150

[56] References Cited

U.S. PATENT DOCUMENTS

| | | | |
|---|---|---|---|
| 3,034,327 | 5/1962 | Garmon, Jr. et al. | 70/70 |
| 3,478,547 | 11/1969 | Constable | 70/71 |
| 3,756,639 | 9/1973 | Wilkinson | 292/150 X |
| 3,961,505 | 6/1976 | Gehrie et al. | 70/71 X |
| 4,356,712 | 11/1982 | Bako | 70/69 |
| 4,559,796 | 12/1985 | De Forrest, Sr. | 70/432 |

*Primary Examiner*—Lloyd A. Gall
*Attorney, Agent, or Firm*—Browdy and Neimark

[57] ABSTRACT

A chest lock has a linking action and consists of a base, a lock tool set mounted on the base and composed of a lock tool and two linking members which are located at two ends of the lock tool, two retaining members disposed at two ends of the lock tool set such that the retaining members are actuated by the linking members to slide on the base, two lock retainer sets consisting of a lock retainer seat, a slide block and a lock retainer. The lock retainer seat is disposed at one end of the base for the retaining hook to be inserted thereinto. The outer ends of the retaining members are inserted into the lock retainer seats. The slide blocks are slidably disposed in the lock retainer seats and provided with a retaining portion corresponding to the retaining hook. The lock retainer has a body which is pivoted at one portion thereof with the lock retainer seat, and connected at other portion thereof with the slide block.

9 Claims, 5 Drawing Sheets

CHEST LOCK HAVING A LINKING ACTION

FIELD OF THE INVENTION

The present invention relates generally to a locking device, and more particularly to a locking device suitable for use in fastening the cover with the shell of a chest and the like.

BACKGROUND OF THE INVENTION

The conventional way of fastening the cover with the shell of a box, chest, etc. involves the use of the hooked body of a locking device in such a manner that the hooked body traverses the corresponding outer sides of the cover and the shell. Another conventional way involves the use of an elongated locking device which consists of an elongated main body, a pair of lock retainers, a pair of retaining members, a pair of press buttons, and a combination lock. The main body is fastened with the shell. The combination lock is disposed in the center of the main body. The lock retainers are fastened pivotally with both ends of the main body such that they are corresponding in location to a pair of lock hooks. The retaining members are respectively disposed between the lock retainers and the combination lock. The press buttons are disposed on the lock retainers. When the lock is in a releasing state, the user may press the press buttons to force the lock retainers to disengage the lock hooks, thereby enabling the cover to be separated from the shell. When the user turns the combination lock to cause the lock to remain in the locking state, the two retaining members are forced by the combination lock to remain stationary such that the stationary retaining members keep the press buttons in the stationary state. As a result, the cover and the shell can not be separated from each other.

Such a prior art locking device as described above is defective in design in that it is rather complicated in construction, and that the retaining members must be located with precision between the combination locks and the press buttons, and further that it can not be assembled easily, and still further that it fails easily.

SUMMARY OF THE INVENTION

It is therefore the primary objective of the present invention to provide a chest lock having a linking action. The lock is simple is construction such that it can be easily assembled.

It is another objective of the present invention to provide a chest lock having a linking action. The lock can be made with less precision requirements.

It is still another objective of the present invention to provide a chest lock having a linking action. The lock does not fail easily.

In keeping with the principle of the present invention, the foregoing objectives of the present invention are attained by a lock consisting of a base, a lock tool set, two retaining members and two lock retainer sets. The base of a predetermined length is disposed at a predetermined position of the shell of a box and the like. The lock tool set is disposed at a predetermined position of the base and composed of one lock tool and two linking members which are disposed at both ends of the lock tool such that the linking members are capable of displacing along with the changes in the locking position and the unlocking position of the lock tool. The two retaining members of a predetermined length are mounted on the base such that they are located at both ends of the lock tool set, and that they are capable of sliding along the direction of the longitudinal axis of the base. Each of the two retaining members is connected at the inner end thereof with the linking members such that each of the retaining members is actuated by the linking members to slide on the base. Each of the two lock retainer sets has a lock retaining seat, a sliding block and a lock retainer. The lock retainer seat is disposed at one end of the base such that the retaining hook extends through one side of the lock retaining seat. Each of the retaining members has an outer end which extends into the lock retainer seat. The sliding block is movably disposed in the lock retainer seat and is provided thereon with a retaining portion corresponding to the position at which the retaining hook extends. The lock retainer is elongated and fastened pivotally at one portion of the body thereof with the lock retainer seat. Another portion of the body of the lock retainer is connected with the sliding block. The lock retainer is in a locking state at the time when the lock retainer swivels to join with the lock retainer seat, thereby actuating the sliding block to move to a first position. When the lock retainer swivels away from the lock retainer seat, the lock retainer is in an unlocking state to actuate the sliding block to move to a second position. When the lock tool is located at the locking position, the lock tool actuates each of the retaining members to slide toward one end of the base to retain the lock retainer seat, so as to cause the lock retainer seat to remain in the locking state. When the lock tool is located at the unlocking position, the lock tool actuates each of the retaining members to slide toward the other end of the base to release the lock retainer seat, so as to enable the lock retainer seat to swivel to remain in the unlocking state.

The detailed structures, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
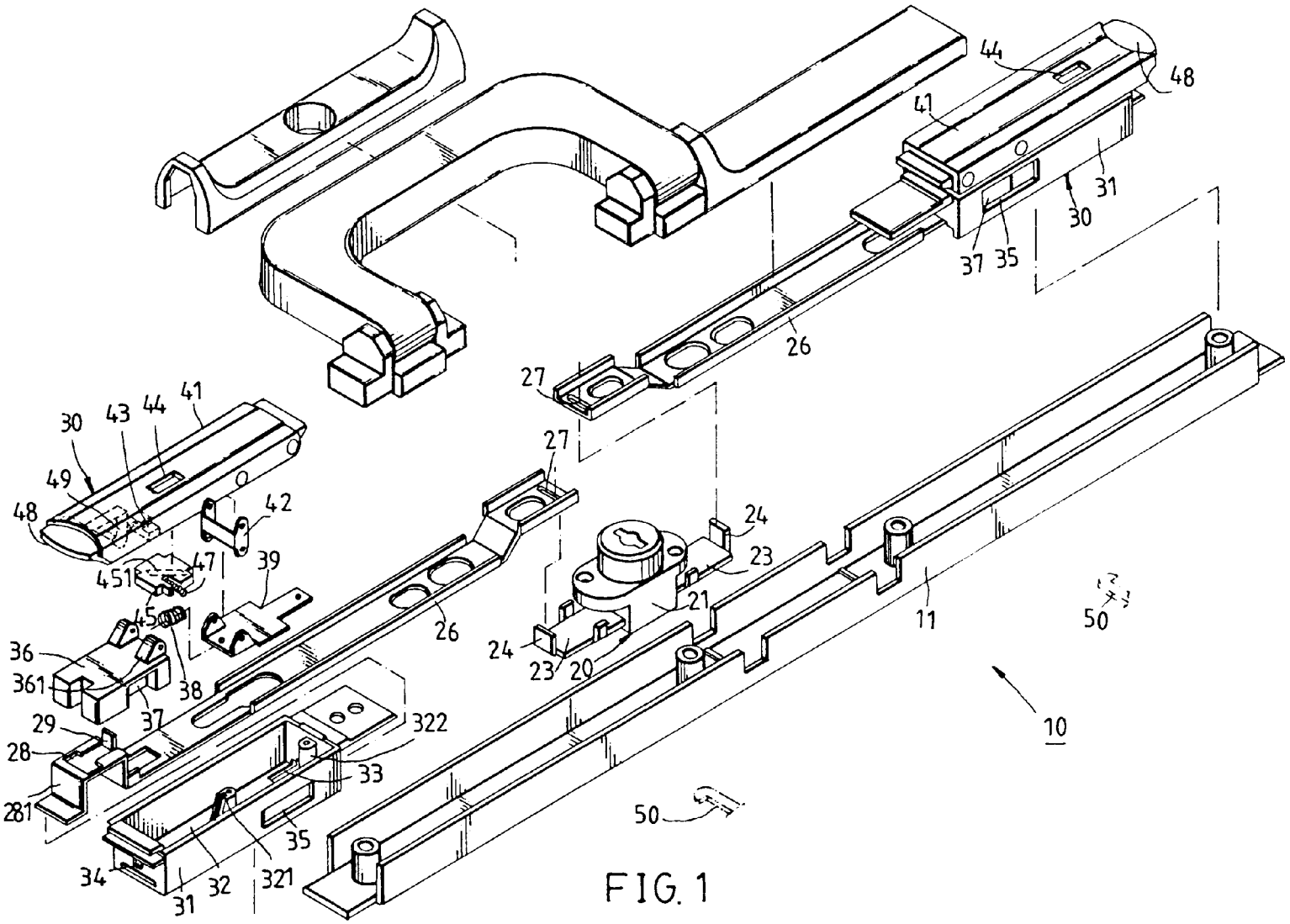
FIG. 1 shows an exploded view of the first preferred embodiment of the present invention.
Figure 2:
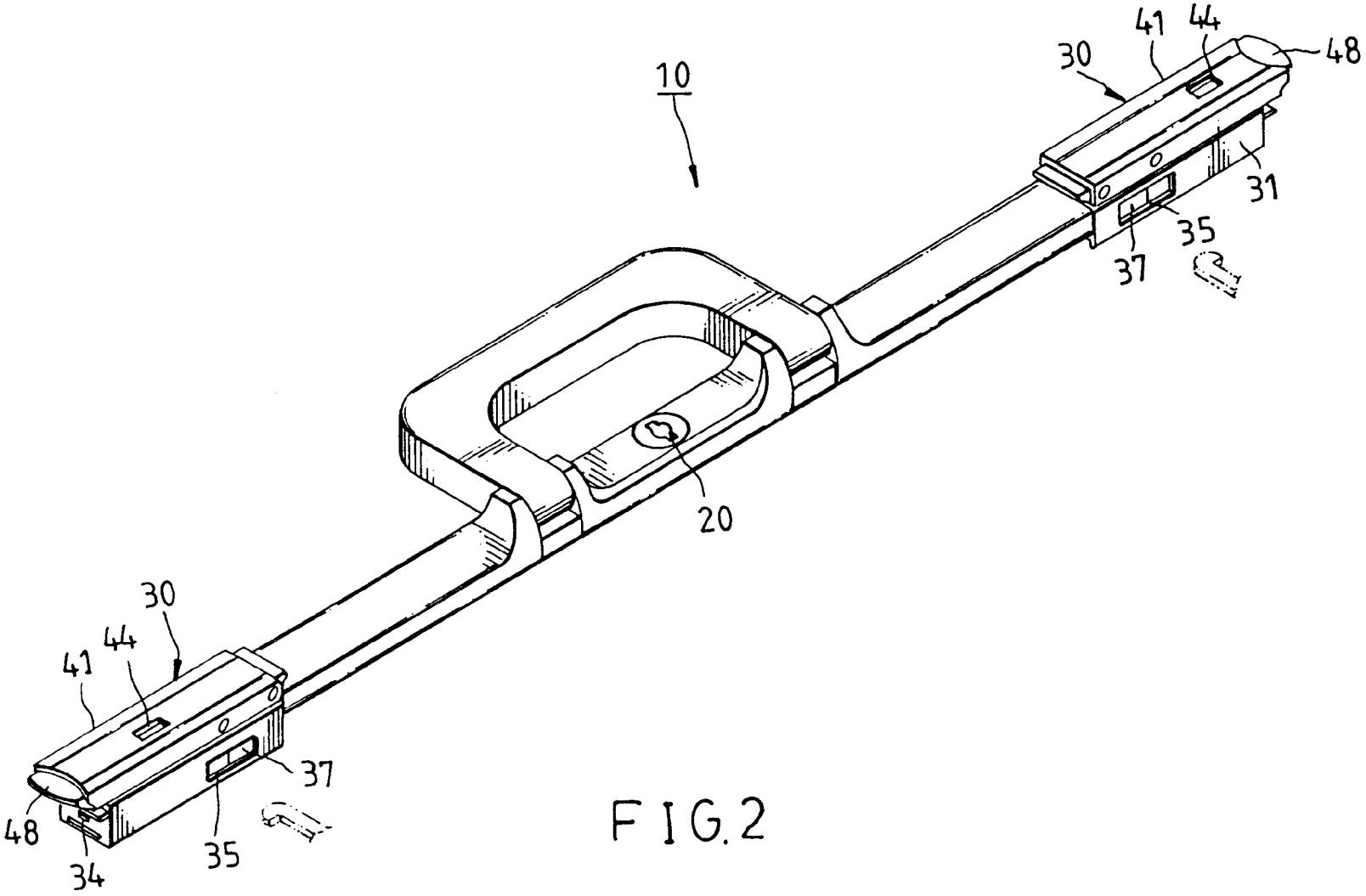
FIG. 2 shows a perspective view of the first preferred embodiment of the present invention in combination.
Figure 3:
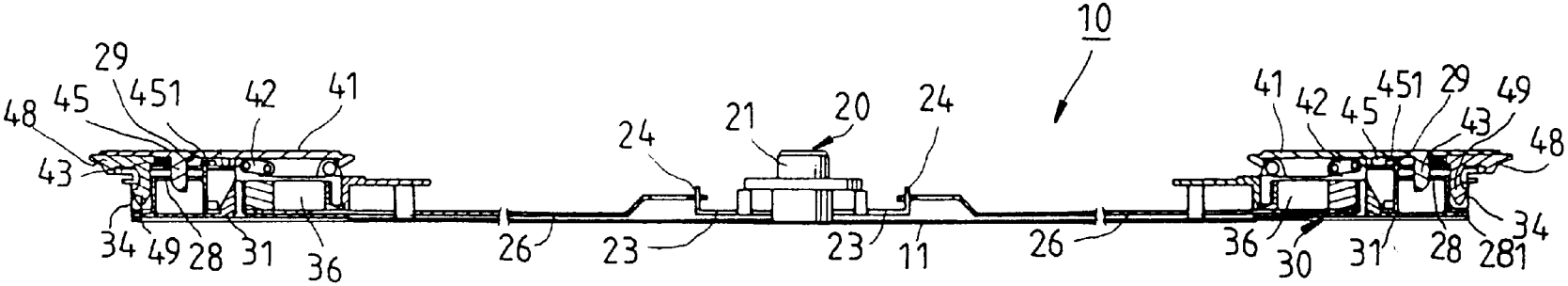
FIG. 3 shows a longitudinal sectional view of the preferred embodiment of the present invention.
Figure 4:
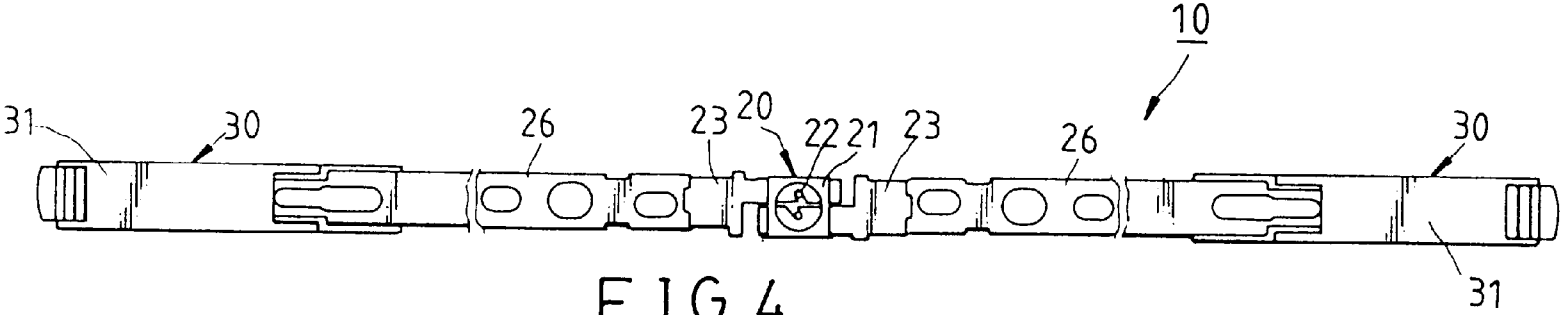
FIG. 4 shows a bottom view of the present invention with base being removed.

As shown in FIGS. 1–4, a locking device 10 of the box and the like of the present invention is composed of the following component parts.

A base 11 of a long striplike construction is located at a predetermined position of the box body of the box and the like.

A lock tool set 20 has a lock tool 21 and two linking members 23. The lock tool 21 is a lock core capable of being driven by a key. The two linking members 23 are connected with the lock tool 21. When the lock tool 21 is located at the unlocking position and the locking position, the two linking members 23 are actuated by two protrusions 22 of the bottom of the lock tool to move outwards or inwards. The two linking members 23 are provided at the other end thereof with an insertion piece 24 extending upwards.

Two retaining members 26 of a long striplike construction is movably located at both ends of the lock tool set 20 such that the retaining members 26 can slide along the direction of the longitudinal axis of the base 11. The two retaining members 26 are provided at one end thereof with an insertion hole 27 and connected respectively with the insertion piece 24 of the linking members 23 so as to be linked with the lock tool 21. The retaining members 26 are provided at the outer end thereof with a retaining portion 28 of a T-shaped hole, an urging plate 281, and a push plate 29.

Two lock retainer members 30 have a lock retainer seat 31, a slide block 36, and a lock retainer 41. The lock retainer seat 31 is of a long striplike construction and is located at one end of the base 11. The lock retainer seat 31 has a receiving cell 32 with an opening facing upward. The lock retainer seat 31 is provided in the inner end thereof with a through hole 33, in the outer end thereof with a retaining portion 34, and in one side thereof with a side hole 35. The retaining member 26 is located in the lock retainer seat 31 such that the outer end of the retaining member 26 is put through the through hole 33. The slide block 36 is rectangular and located slidably in the lock retainer seat 31 such that the slide block 36 can slide along the longitudinal axis of the lock retainer seat 31. The slide block 36 is provided in one side thereof with a retaining portion 37 corresponding to the side hole 35. An elastic element 38 is disposed between the slide block 36 and the lock retainer seat 31 for providing an elastic force enabling the slide block 36 to slide outwards. The lock retainer seat 31 has a fastening plate portion 39, which is fastened at both ends thereof with two locating columns 321 and 322 of the receiving cell 32 for confining the slide block 36 to slide horizontally between the bottom wall of the base 11 and the fastening plate portion 39. The lock retainer 41 is of a long striplike construction and is fastened pivotally at one end thereof with two lugs 361 of the slide block 36. A rocking arm 42 is pivoted at both ends thereof with the fastening plate 39 and the midsegment of the lock retainer 41. The lock retainer 41 swings within a predetermined angle in relation to the lock retainer seat 31 on the fastening plate portion 39 serving as a fulcrum and by means of the rocking arm 42. In the swinging process, the slide block 36 is actuated by the lock retainer 41 to slide back and forth. The lock retainer 41 is provided with an inverted T-shaped hook portion 43 corresponding to the retaining portion 28 of the retaining member 26. The hook portion 43 catches the narrow end of the retaining portion 28 to bring about the retaining action. The lock retainer 41 is provided at the top thereof with a window 44. A displaying member 45 is provided at the top thereof with words "OPEN" and "LOCK" corresponding to the window 44. The displaying member 45 is provided in the bottom thereof with an inclined slot 451 and connected with the push plate 29 of the retaining member 26. The displaying member 45 is pushed to displace by the push plate 29, thanks to the displacement of the retaining member 26. As a result, a horizontal displacement of the displaying member 45 is brought about. An elastic element 47 is disposed between the displaying member 45 and the lock retainer 41 for providing an elastic force enabling the displaying member 45 to move in a constant direction. A press button 48 is located at the outer end of the lock retainer 41 and is provided in the bottom thereof with a hook portion 49. When the press button 48 is not exerted on by an external force, the press button 48 is urged by an elastic element so as to enable the hook portion 49 to catch the retaining portion 34 of the lock retainer seat 31. When the retaining member 26 displaces, the urging plate 281 presses against the hook portion 49 of the press button for confining the unlocking effect to bring about the retaining action.

Figure 5:
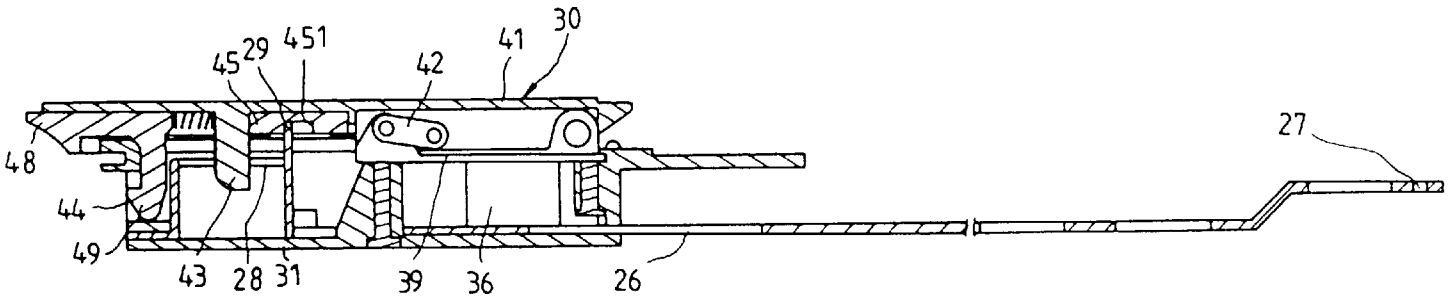
FIG. 5 shows a schematic view of the component parts in action at the time when the present invention is in the locking state.
Figure 6:
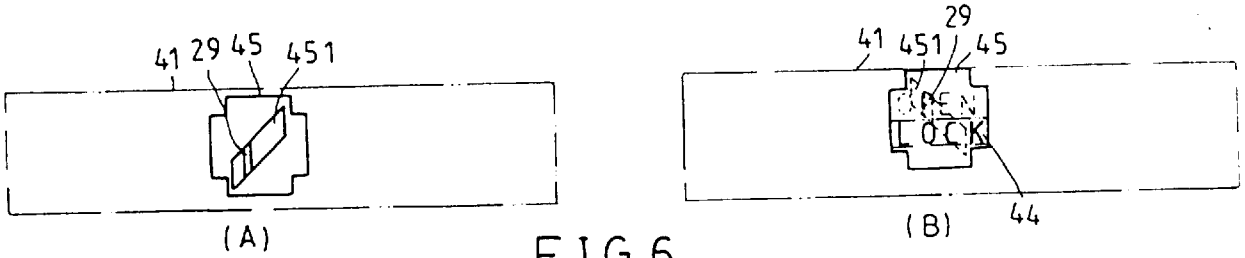
FIG. 6 shows a schematic view of the displaying member in action at the time when the present invention is locked.

As shown in FIG. 5, when the present invention is in the locking state, the lock tool set 20 is located at the locking position. In the meantime, the retaining member 26 moves outwards such that the narrow end of the retaining portion 28 catches the hook portion 43 of the lock retainer 41. The urging plate 281 of the retaining member 26 urges the hook portion 49 of the press button 48. As a result, the press button 48 can not be relieved of the arresting force. In the locking state, the displaying member 45 is pushed by the push plate 29 to move to a position at which the word "LOCK" is visible via the window 44.

Figure 7:
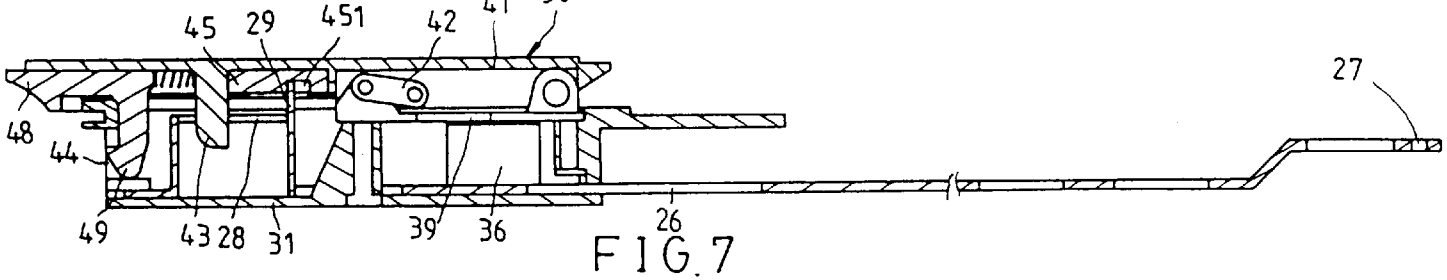
FIG. 7 is a schematic view showing that the lock retainer is not yet opened after the lock tool of the present invention is opened.
Figure 8:
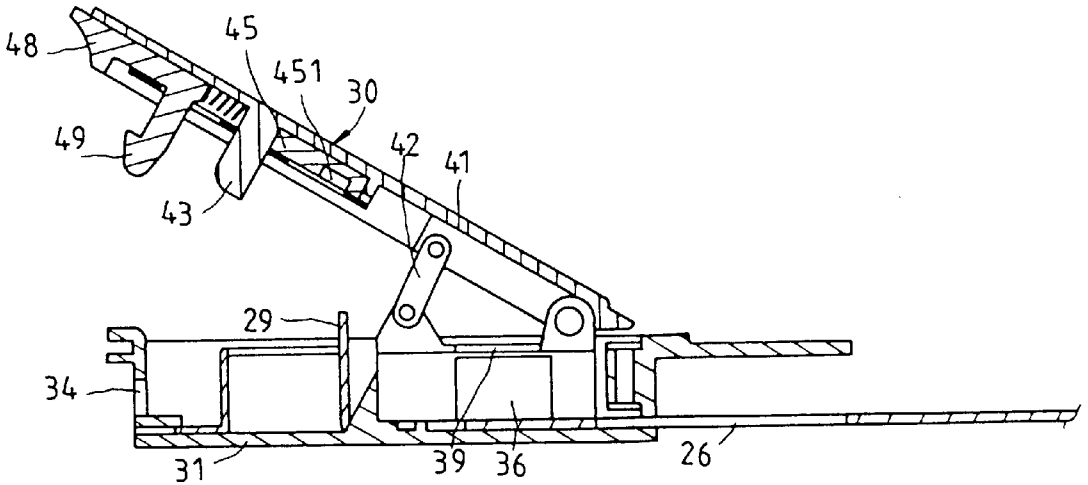
FIG. 8 shows a schematic view of the displaying member in action at the time when the present invention is unlocked.
Figure 9:
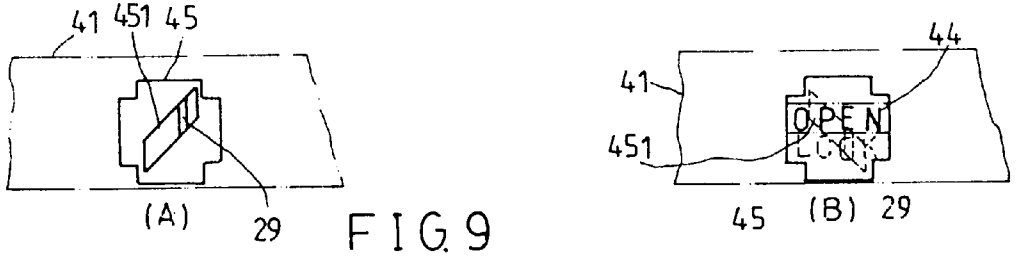
FIG. 9 shows a schematic view of the lock retainer in the opening state after the lock tool of the present invention is opened.

The conversion of the locking state of the present invention into the unlocking state is attained by a key, which is used to turn the lock tool 21 to the unlocking state, thereby causing the linking member 23 to actuate the retaining member 26 to move inwardly, as shown in FIG. 7. In the meantime, the wide end of the retaining portion 28 of the retaining member 26 is moved to be corresponding in location to the hook portion 43 of the lock retainer 41. The lock retainer 41 is not retained by the retaining portion 28. The urging plate 281 moves away from the hook portion 49. The press button 48 is relieved of the arresting force. By means of the inclined slot 451, the push plate 29 of the retaining member 26 drives the displaying member 45 to move horizontally such that the word "OPEN" is displayed via the window 44, as shown in FIG. 9. As the press button 48 is pressed, the hook portion 49 moves away from the retaining portion 34 of the lock retainer seat 31. Thereafter, the lock retainer 41 is swiveled upwards from the closed position to the open position. The lock retainer 41 actuates the slid block 36 to move outwards, as shown in FIG. 8. The retaining portion 37 of the slide block 36 becomes disengaged with the retaining hook 50 of the cover. As a result, the cover can be released.

The conversion of the unlocking state into the locking state of the present invention is attained by inserting the retaining hook 50 into the side hole 35 of the lock retainer seat 31. Subsequently, the lock retainer 41 is pressed back to the closed position from the open position. The hook portion 49 of the press button 48 is engaged with the retaining portion 34 of the lock retainer seat 31 such that the lock retainer 41 is retained on the lock retainer seat 31 so as to recover to the state, as shown in FIG. 7. In the meantime, the slide block 36 is actuated by the lock retainer 41 to move inwards. The retaining portion 37 retains the retaining hook 50 of the cover. As a result, the cover is retained with the box body. As the lock tool 21 is turned from the unlocking position to the locking position, the retaining members 26 are actuated to move outwards. As a result, the hook portion 49 of the lock retainer 41 is once again retained by the retaining portion 28 such that lock retainer can not be opened. In the meantime, the displaying member 45 is actuated by the linking action of the push plate 29 of the displaying member 45 to displace in other direction to display the word "LOCK" via the window 44. The hook portion 49 of the press button 48 is urged by the urging plate 281 such that the press button 48 is locked, and that the conversion of the unlocking state into the locking state is completed.

There are two locking forms which can be attained by the locking of the hook portion 43 or the press button 48.

What is claimed is:

1. A chest lock having a linking action and adapted to be fastened with one of two chest shells for locking a retaining hook of the other one of the two chest shells, said lock comprising:

a base of a predetermined length and adapted to be mounted on a predetermined portion of a body of the chest and the like;

a lock tool set disposed at a predetermined position of said base and composed of a lock tool, and two linking members which are fastened with two ends of said lock tool such that said linking members displace according to a locking position and an unlocking position of said lock tool;

two retaining members of a predetermined length and mounted on said base such that said retaining members are movably located at two ends of said lock tool set, and that said retaining members slide along the direction of a longitudinal axis of said base, and further that said retaining members are connected at an inner end thereof with said linking members; and two lock retainer sets each having a lock retainer seat, a slide block and a lock retainer, said lock retainer seat being mounted at one end of said base and having a side for said retaining hook to be inserted thereinto, an outer end of each of said retaining members being inserted into said lock retainer seat, said slide block being disposed in said lock retainer seat such that said slide block displaces in said lock retainer seat, said slide block provided with a retaining portion corresponding to an insertion position of said retaining hook, said lock retainer having a long shape, and a body pivoted at one portion thereof with said lock retainer seat such that said body swivels on said lock retainer seat, said body connected at another portion thereof with said slide block, said lock retainer being swiveled to join with said lock retainer seat so as to bring about a locking state and to actuate said slide block to displace to a first position, said lock retainer being swiveled away from said lock retainer seat so as to bring about an unlocking state and to actuate said slide block to move to a second position;

said lock tool actuating each of said retaining members to slide toward one end of said base and retaining said lock retainer at such time when said lock tool is located at a locking position, thereby keeping said lock retainer in said locking state; said lock tool actuating each of said retaining members to slide toward the other end of said base and releasing said lock retainer at such time when said lock tool is located at an unlocking position, thereby enabling said lock retainer to remain in said unlocking state.

2. The chest lock as defined in claim 1, wherein said lock retainers are provided with a window, a displaying member mounted in an underside of said lock retainer such that said displaying member is capable of displacing on said lock retainer, and an elastic element disposed between said displaying member and said lock retainer for providing an elastic force to keep said displaying member to move in a constant direction; and wherein said retaining members are provided with a push plate corresponding to said displaying member and capable of actuating said displaying member to displace.

3. The chest lock as defined in claim 1, wherein each said lock retainer set further comprises a rocking arm pivoted at both ends thereof with a midsegment of said lock retainer and said lock retainer seat; wherein said lock retainer is pivoted at one end thereof with said slide block such that said lock retainer is capable of swiveling by means of said rocking arm in a range of a predetermined angle, so as to actuate said slide block to slide horizontally in said lock retainer seat.

4. The chest lock as defined in claim 1, wherein said lock retainer seats are provided therein with a fastening plate portion for forming a confined space along with said lock retainer seat; and wherein said slide block slides horizontally in said confined space.

5. The chest lock as defined in claim 1, wherein said retaining members are provided in an outer end thereof with a retaining portion; wherein said lock retainers are provided with a hook retaining portion; and wherein said retaining portion and said hook retaining portion bring about a retaining or releasing relationship at the time when said retaining members displace.

6. The chest lock as defined in claim 5, wherein said hook retaining portion of said lock retainer is a hook portion having an inverted T shape; wherein said retaining portion of said retaining members is a T-shaped hole; and wherein said hook portion has a head end which is inserted into a wide end of said retaining portion such that a narrow end of said retaining portion is caught by said hook portion at the time when said retaining members displace.

7. The chest lock as defined in claim 5, wherein said retaining portion is an urging plate; wherein said hook retaining portion is an urging plate; wherein said hook retaining portion of said lock retainer is a press button located at an outer end of said lock retainer, said press button provided in a bottom thereof with a hook portion engageable with a retaining portion located at an outer end of said lock retainer seat; and wherein said press button is confined by said urging plate to displace so as to keep said hook portion to retain said retaining portion at the time when said retaining members displace.

8. The chest lock as defined in claim 1 wherein each said linking member is provided with an insertion piece; each said retaining member is provided at one end thereof with an insertion hole connected with the insertion piece of said linking member.

9. The chest lock as defined in claim 1 further comprising two elastic elements located between said slide blocks and said lock retainer seats for providing an elastic force for keeping said slide blocks to move in a direction.

* * * * *